United States Patent [19]

McAvoy et al.

[11] Patent Number: 4,893,439

[45] Date of Patent: Jan. 16, 1990

[54] ABRASIVE ARTICLE CONTAINING HELICALLY CRIMPED FIBERS

[75] Inventors: Thomas R. McAvoy, Stillwater; Fred H. Bland, Woodbury, both of Minn.

[73] Assignee: Minnesota Mining and Manufacturing Company, St. Paul, Minn.

[21] Appl. No.: 230,673

[22] Filed: Aug. 5, 1988

Related U.S. Application Data

[63] Continuation of Ser. No. 38,062, Apr. 14, 1987, abandoned.

[51] Int. Cl.[4] ..... B24D 13/14

[52] U.S. Cl. ..... 51/400; 51/401; 428/371; 15/230; 15/230.13

[58] Field of Search ..... 51/295, 297, 394, 398, 51/400, 401, 403, 404, 407; 15/230, 230.13; 28/259, 260; 428/371

[56] References Cited

U.S. PATENT DOCUMENTS

| | | | |
|---|---|---|---|
| 1,959,104 | 5/1934 | Mahan | 28/260 X |
| 2,643,494 | 6/1953 | Erickson | 51/297 X |
| 2,931,089 | 4/1960 | Evans | 28/1 |
| 2,958,593 | 11/1960 | Hoover et al. | 51/295 |
| 3,025,584 | 3/1962 | Evans | 28/1 |
| 3,387,956 | 6/1968 | Blue | 51/297 |
| 3,431,689 | 3/1969 | Schnabel | 51/400 |
| 3,537,121 | 11/1970 | McAvoy | 15/230.12 |
| 3,595,738 | 7/1977 | Clarke et al. | 161/169 |
| 3,619,874 | 11/1971 | Li et al. | 28/1.5 |
| 3,663,352 | 5/1972 | Self et al. | 28/259 X |
| 3,868,749 | 3/1975 | Cate | 28/72.15 |
| 4,227,350 | 10/1980 | Fitzer | 51/295 |
| 4,331,453 | 5/1982 | Dau et al. | 51/400 X |
| 4,355,067 | 10/1982 | Neveu | 428/371 X |
| 4,355,489 | 10/1982 | Heyer et al. | 51/297 X |
| 4,437,271 | 3/1984 | McAvoy | 51/400 |

OTHER PUBLICATIONS

Allan et al., *Frontiers of Nonwoven Fabric Technology*, University of Washington, Seattle, Wash., pp. 4–13 (no date available).

Backer, *Yarn*, Scientific American, vol. 227, No. 6, pp. 46–56 (Dec. 1972).

Monsanto Textile Division, *Textured Yarn Technology—Production, Properties, and Processing*, vol. 1, pp. 107–115 (1967).

*Primary Examiner*—Robert P. Olszewski

*Attorney, Agent, or Firm*—Donald M. Sell; Walter N. Kirn; David L. Weinstein

[57] ABSTRACT

Abrasive article comprising an open, lofty nonwoven web comprising helically crimped synthetic organic fibers. The article can optionally contain stuffer box crimped fibers and melt bondable fibers. The presence of helically crimped fibers brings about greater durability and greater capacity for absorbing debris.

13 Claims, 1 Drawing Sheet

ABRASIVE ARTICLE CONTAINING HELICALLY CRIMPED FIBERS

This is a continuation of application Ser. No. 038,062, filed Apr. 14, 1987, now abandoned.

BACKGROUND OF THE INVENTION

This invention relates to articles for cleaning, buffing, conditioning, or restoring surfaces.

For at least the last 25 years, abrasive articles made from nonwoven fibers have been used for cleaning floors and other surfaces.

Hoover, et al, U.S. Pat. No. 2,958,593 discloses nonwoven fibrous abrasive articles of extremely open structure having an extremely high void volume. This article has been found to be useful in floor maintenance, in hand scouring operations such as performed in domestic kitchens, as well as in various industrial abrasive operations.

McAvoy, U.S. Pat. No. 3,537,121 discloses a soft, resilient compressible polishing pad having a lofty fibrous nonwoven structure bonded by a soft, tough resin containing a finely divided soft mineral filler. This pad is comparable to pads made of lamb's wool with respect to ability to impart luster to buffable waxes. This pad can be used to clean and restore the surface of hard polymer coatings without powdering. This pad also does not scratch or abrade the surface, nor does it impart swirl marks to the finish of the surface.

Fitzer, U.S. Pat. No. 4,227,350 discloses a low density abrasive product comprising a uniform cross section, porous, lofty web of autogeneously bonded continuous, undulated, interengaged filaments. The web is impregnated with a tough binder resin which adherently bonds the filaments of the web together and also bonds a multitude of abrasive granules, uniformly dispersed throughout the web, to the surface of the filaments.

Although the articles disclosed in the aforementioned patents are extremely useful for the purposes for which they are intended, they rapidly lose their efficiency as they become saturated with dirt. It is known that as the void volume of a nonwoven pad is increased, its ability to absorb more dirt is increased. However, as the void volume is increased the life of the pad is simultaneously decreased. In view of this problem, it has long been desired to provide a nonwoven fibrous pad having a high void volume and a high level of durability.

SUMMARY OF THE INVENTION

This invention provides a low density, nonwoven abrasive article having a nonwoven fibrous web comprising helically crimped fibers derived from synthetic organic material. It is preferred that at least about 30% by weight of the fibrous web of this product be made of helically crimped fibers.

The helically crimped fibers must have crimp frequency high enough so that the web formed therefrom is lofty and open, but they must not have so high a crimp frequency that they cannot be processed by conventional nonwoven web-making equipment. It is preferred that the helically crimped fibers be stabilized or set, preferably by heating the fibers, so that subsequent heating thereof will not adversely affect the character of the helically crimped fibers and nonwoven webs produced therefrom.

Optionally, the nonwoven web used in this invention can contain stuffer box crimped fibers and melt bondable fibers. When activated by heat, the melt bondable fibers help to stabilize the nonwoven webs of this invention.

Depending upon the intended application of the articles of this invention, fillers, colorants, abrasive particles, or additional binders can be incorporated into the nonwoven web.

Because the nonwoven abrasive articles of this invention are more open and lofty than those of the prior art, they are capable of being filled with more debris during use. Although they are more open and lofty, they are more durable than nonwoven abrasive articles of the prior art.

DETAILED DESCRIPTION

Figure 1:
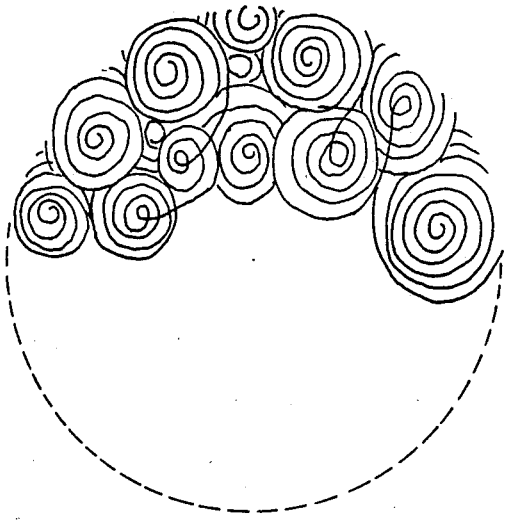
FIG. 1 is a plan view, greatly enlarged, of an article of this invention.
Figure 2:
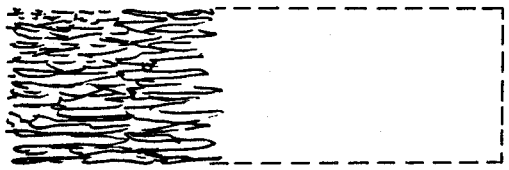
FIG. 2 is a side view in elevation of an article of this invention.

As used herein, the term "abrasive article" is intended to include articles which can perform any one or more of the following functions: rubbing, wearing away, polishing, cleaning, buffing, or otherwise conditioning.

The abrasive articles of this invention comprise nonwoven webs that are characterized by being comprised of helically crimped fibers. Fibers are crimped into a helical configuration by relief of bi-lateral differential forces in a fiber or composite fiber. These bi-lateral differential forces are produced by either coextrusion of polymers having at least some stress/strain differential properties, or induction of differential stress by passing the fiber over an edge. Although helically crimped synthetic fibers are well known, the use thereof in nonwoven abrasive products has never been disclosed.

Helically crimped fibers useful in the practice of this invention must have a sufficiently high degree of crimp to form a lofty, open nonwoven web but not so high a level of crimp that these fibers cannot be processed by conventional nonwoven web-making equipment.

Preferably the void volume is maintained within the range of from about 85 percent to at least about 95 percent. Structures wherein the void volume is somewhat less than 85 percent are useful for the purposes of this invention though not ordinarily recommended. On the other hand, where the void volume is decreased below about 75 percent, it has been found that the outstanding and advantageous properties diminish rapidly. For example, the ready flushability or cleanability of the floor cleaning structures, and therewith the abrasive cutting rate, etc. drops off.

It is preferred to form the web component of our combination structures from synthetic fibers such as nylon and polyesters (e.g., "Dacron"). The uniformity and quality of such types of fibers can be closely controlled. Also, these fibers retain substantial of their physical properties when wet with water or oils. Because the articles hereof often are subjected to water, oils, cleaners, chemicals, and the like, fibers should be selected which maintain substantial of their essential characteristics when subjected to media to which they will be exposed in the desired particular use. However, it may be mentioned that certain deficiencies, e.g., low wet strength, in some fibers may be improved by appropriate treatment thereof.

Typically, helically crimped fibers have about 1 to 15 full cycle crimps per 25 mm fiber length, while stuffer box crimped fibers have about 3 to 15 full cycle crimps per 25 mm fiber length. In the articles of the present invention, when helically crimped fibers are used in conjunction with stuffer box crimped fibers, it is preferred that the helically crimped fibers have fewer crimps per specified length than the conventional stuffer box crimped fibers. As a typical example, for an article comprised solely of 50 denier fiber, helically crimped fibers having about three full cycle crimps per 25 mm can be advantageously used in conjunction with stuffer box crimped fibers having about five full cycle crimps per 25 mm. The crimp frequency is measured while the fibers are placed under very mild stress. The "Low Load", as given in Table I below, is applied to the individual fiber before counting the number of full cycle crimps per 25 mm fiber length.

TABLE I

| Denier range | Low load (g) | High load (g) |
|---|---|---|
| 0–25 | Denier $\times 2 \times 10^{-3}$ | Denier $\times 50 \times 10^{-3}$ |
| 26–40 | 0.05 | 3 |
| 41–75 | 0.1 | 5 |
| 76–125 | 0.2 | 10 |
| 126–175 | 0.3 | 15 |
| 176–225 | 0.4 | 20 |

Crimp index, a measure of fiber crimp elasticity is preferably about 35 to 70 percent for helically crimped fibers, which is about the same as for stuffer box crimped fibers. Crimp index can be determined by measuring fiber length with appropriate "High Load" attached, then subtracting fiber length with appropriate "Low Load" attached, and then dividing the resulting value by fiber length and multiplying that value by 100. The crimp index can also be determined after exposing the test fibers to an elevated temperature, e.g. 135° C. to 175° C. for 5 to 15 minutes, and this value compared with the index before heat exposure. Crimp index measured after the fiber is exposed for 5 to 15 minutes to an elevated temperature, e.g. 135° C. to 175° C., should not significantly change from that measured before heat exposure. The load can be applied either horizontally or vertically.

By and large, the length of the fibers which may be employed is dependent upon the limitations of the processing equipment upon which the nonwoven open web is formed. However, depending on types of equipment, fibers of different lengths, or combinations thereof, very likely can be utilized in forming the lofty open webs of the desired ultimate characteristics herein specified. Fiber lengths suitable for helically crimped fibers preferably range from about 60 to about 150 mm, whereas suitable fiber lengths for stuffer box fibers range from about 25 to about 70 mm. Likewise, the thickness of the fibers usually is not crucial (apart from processing), due regard being had to the resilience and toughness ultimately desired in the resulting web. Generally, larger denier fibers are preferred for more abrasive articles, and smaller denier fibers are preferred for less abrasive articles. Fiber size must be suitable for lofty, open, low density abrasive products. Typically, fiber size ranges from about 6 to about 400 denier per filament.

The helically crimped fibers are preferably stabilized or set, preferably by application of heat, so that, if they are subsequently heated to cure a subsequently applied adherent coating, the crimp frequency will not be significantly changed. To insure that crimp frequency will not be changed and that nonwoven webs made from helically crimped fibers will not change appreciably in thickness when subjected to temperatures in the range of 150° C. to 175° C., the temperature for curing adherent coatings, helically crimped fibers are preferably heat set at temperatures at least slightly higher than these curing temperatures. Change in crimp frequency prior to or during initial fiber bonding process would cause the thickness of the nonwoven webs formed of these fibers to change excessively or cause the webs to become excessively weak, and consequently unsuitable for use in lofty, open nonwoven abrasive products.

Mixtures of helically crimped and conventional stuffer box crimped synthetic organic fibers can be used in the practice of this invention. Nonwoven webs suitable for preparing low density nonwoven abrasive products of this invention preferably comprise at least about 30% by weight of helically crimped synthetic organic fibers, more preferably at least about 50% by weight of helically crimped synthetic organic fibers, and most preferably at least about 70% by weight of helically crimped synthetic organic fibers.

As compared with nonwoven low density abrasive pads containing less than about 30% by weight helically crimped fibers, nonwoven low density abrasive pads of this invention have more resistance to wear and disintegration. Increasing the helically crimped fiber content of these nonwoven abrasive pads generally improves performance. It should be noted that nonwoven webs and abrasive products made from nonwoven webs containing at least about 30% by weight helically crimped fibers have greater thickness, given equal fiber size and weight, when compared to webs and abrasive products made from conventional stuffer box crimped fibers. Although nonwoven, lofty, open abrasive products which have greater loft or thickness for a given fiber weight, fiber size, coating material, coating weight, and abrasive content would be expected to be less resistant to wear and disintegration under severe use conditions, the abrasive pads of this invention, which contain at least 30% by weight helically crimped fibers, exhibit both a higher level of openness and a higher level of durability than do abrasive pads containing less than 30% by weight helically crimped fibers.

U.S. Pat. No. 3,595,738, incorporated herein by reference, discloses methods for the manufacture of helically crimped bicomponent polyester fibers suitable for use in this invention. The fibers produced by the method of that patent have a reversing helical crimp. Fibers having a reversing helical crimp are preferred over fibers that are helically crimped in a coiled configuration like a coiled spring. However, both types of helically crimped fibers are suitable for this invention. U.S. Pat. Nos. 3,868,749, 3,619,874 and 2,931,089, all of which are incorporated herein by reference disclose various methods of edge crimping synthetic organic fibers to produce helically crimped fibers. Edge crimped fibers are usually formed in a unidirectional coiled configuration but may be of the reversing helically crimped type or may be combinations of both types. Typically, reversing helically crimped fibers have fewer crimps per unit length than do unidirectionally coiled helically crimped fibers.

Melt bondable fibers can optionally be used in the practice of this invention to provide initial bonding of the filaments of formed nonwoven web to increase web integrity and to help stabilize the web in order to facilitate application of subsequent coatings. Melt bondable fibers suitable for this invention must be activatable at elevated temperatures below temperatures which would adversely affect the helically crimped fibers. Additionally, these fibers are preferably coprocessable with the helically crimped fibers to form a lofty, open unbonded nonwoven web using conventional nonwoven web forming equipment. Typically, melt bondable fibers have a concentric core and a sheath, have been stuffer box crimped with about 6 to 12 crimps per 25 mm, and have a cut staple length of about 25 to about 100 mm. Composite fibers have a tenacity of about 2–3 g/denie. Alternatively, melt bondable fibers may be of side-by-side construction or of eccentric core and sheath construction. Preferred deniers of melt bondable fibers are six and larger.

Many types and kinds of abrasive particles and binders can be employed in the nonwoven webs of the articles of this invention. In selecting these components, their ability to adhere firmly to the fibers employed must be considered, as well as their ability to retain such adherent qualities under the conditions of use.

Generally, it is highly preferable that the binder materials exhibit a rather low coefficient of friction in use, e.g., they do not become pasty or sticky in response to frictional heat. However, some materials which of themselves tend to become pasty, e.g., rubbery compositions, can be rendered useful by appropriately filling them with particulate fillers. Binders which have been found to be particularly suitable include phenolaldehyde resins, butylated urea aldehyde resins, epoxide resins, polyester resins such as the condensation product of maleic and phthalic anhydrides and propylene glycol, acrylic resins, styrene-butadiene resins, and polyurethanes.

Amounts of binder employed ordinarily are adjusted toward the minimum consistent with bonding the fibers together at their points of crossing contact, and, in the instance wherein abrasive particles are also used, with the firm bonding of these particles as well. Binders and any solvent from which the binders are applied, also should be selected with the particular fiber to be used in mind so embrittling penetration of the fibers does not occur.

Representative examples of abrasive materials useful for the nonwoven webs of this invention include, for example, silicon carbide, fused aluminum oxide, garnet, flint, emery, silica, calcium carbonate, and talc. The sizes or grades of the particles can vary, depending upon the application of the article. Typical grades of abrasive particles range from about 36 to about 1000.

Conventional nonwoven web making equipment can be used to make webs of helically crimped fibers or blends of helically crimped and stuffer box crimped fibers with or without melt bondable fibers. Air laid nonwoven webs comprising helically crimped fibers can be made using equipment commercially available from Dr. O. Angleitner (DOA), Proctor & Schwarz, or Rando Machine Corporation. Mechanical laid webs can be made using equipment commercially available from Hergeth KG, Hunter, or others. During manufacture of crimped fibers, lubricants are typically used to facility processing. However, excessive lubricant coatings on the crimped fibers may impede processing crimped fibers into nonwoven webs.

The following non-limiting examples will further serve to illustrate this invention.

EXAMPLE 1

A random air-laid nonwoven web having a weight of about 460 g/m$^2$ and a thickness of about 50 mm was formed by means of a DOA machine, a commercially available web forming device. The web was formed from a preblended mixture of 70% by weight 60 denier helically crimped polyethylene terephthalate polyester (PET) staple fibers and 30% by weight 15 denier stuffer box crimped bicomponent polyester melt bondable fibers. The helically crimped fibers were formed by edge crimping, were fully tensilized, were cut to 75 to 100 mm staple lengths, had a tenacity of 3.2 g/denier, had 2.7 full cycle crimps per 25 mm, had a crimp index of 42, and had crimp index after heat exposure for 5 minutes at 175° C. of 38. The melt bondable fiber was a stuffer box crimped fiber having a bicomponent sheath/core (modified polyester/polyester) construction, had a tenacity of 3 g/denier, had a staple length of 40 mm, had 9 full cycle crimps per 25 mm, had a crimp index of 9, and had a crimp index of 16 after exposure to heat for 5 minutes at 130° C., and were activatable at 120°–200° C.

In an oven, low velocity air heated to approximately 180° C. was forced through the web for three minutes, causing the bicomponent melt bondable polyester fiber to bond to and stabilize the nonwoven web. The thickness of the nonwoven web was reduced slightly to about 45 mm.

A filled styrene-butadiene rubber latex saturant, having about 70% by weight non-volatile materials was prepared by combining the following ingredients in the amounts indicated:

| Ingredient | Amount (Parts by weight) |
|---|---|
| Water | 3.1 |
| Carboxylated styrene-butadiene rubber (SBR) latex, containing 65% styrene (AmscoRes 5900, commercially available from Union Oil Chemicals) | 43.4 |
| Hexamethylmethoxymelamine (HMMM) resin (Cymel 303, commercially available from American Cyanamid) | 4.6 |
| Calcium carbonate filler | 41.5 |
| Diammonium phosphate, 40% by weight in tap water | 0.4 |
| Hydroxypropyl methylcellulose, 3% by weight dispersion in tap water (Methocel F4M, commercially available from Dow Chemical Co.) | 0.8 |
| Silicone emulsion surfactant (Q2-3168, commercially available from Dow Corning) | 0.1 |
| Dioctyl sodium sulfosuccinate surfactant (Triton GR5M, commercially available from Rohm and Haas) | 0.8 |

The saturant was applied by passing the nonwoven web between a pair of vertically opposed 250 mm diameter rubber covered squeeze rolls. The rotating lower roll, which was immersed in the saturant, carried saturation the nonwoven web, so as to evenly disperse it therethrough. The wet nonwoven web was dried and the saturant cured in a hot air oven at 175° C. for about five to seven minutes. The dry, coated nonwoven web had a thickness of about 38 mm and weighed about 1110 g/m$^2$. The nonwoven web had breaking strengths in the length and cross directions of 9.5 and 11.4 kg/25 mm sample width, respectively.

Abrasion resistance of the nonwoven web was determined by an accelerated wear life test on floor buffing pads having a diameter of 430 mm and die cut from the aforementioned web. A rotating table, having a diameter of 2.4 m and having a surface made of filled vinyl floor tile, was rotated at a rate of 10 revolutions per minute (rpm). To cause accelerated wear, 4 strips, each of which was 100 mm wide and contained 50 grade coated abrasive, was adhered to the vinyl floor tile in a random radial pattern so that the nonwoven floor buffing pad crossed over these strips as the table rotated. The floor buffing pad was driven by a commercial floor buffing machine operating at 175 rpm. The weight of the buffing machine forced the buffing pad against the rotating table. The buffing pad was held and driven by a conventional 430 mm diameter holder/driver, the "Insta-Lok" Brand Driving Assembly, commercially available from Minnesota Mining and Manufacturing Company. The buffing machine and holder/driver had a combined weight of about 59 kg. At the beginning of the test, the table and buffing machine were caused to rotate and the buffing machine was lowered so as to bring its full weight onto the test pad. The test was continued until the test pad was caused to disintegrate by the action of the four abrasive strips. The time elapsed from the beginning of the test was recorded.

The average life of the buffing floor pads of this example was 6.8 minutes; the range was from 2.0 to 11.0 minutes.

COMPARATIVE EXAMPLE A

A nonwoven web was made from a blend of 30% by weight 15 denier melt bondable fiber and 70% by weight 50 denier tensilized polyester staple fiber which had been stuffer box crimped, heat set, and cut to a length of 37 mm. The web was made according to the procedure described in Example 1. The stuffer box crimped fibers had a tenacity of 4 g/denier, had 5 full cycle crimps per 25 mm, and had a crimp index of 26 before and after 5 minute exposure to a temperature of 125° C. The nonwoven web weighed 465 g/m$^2$ and was approximately 37 mm thick. After saturation with the coating composition and cured as described in Example 1, the dried product weighed approximately 1170 g/m$^2$ and was about 28 mm thick. When tested by the accelerated wear test described in Example 1, the average life of the control floor buffing pads was determined to be 1.1 minutes, with a standard deviation of 0.2 minute.

EXAMPLES 2–6

Nonwoven webs were formed from 70% by weight 60 denier helically crimped polyethylene terephthalate polyester fibers and 30% by weight melt bondable fibers as described in Example 1. The webs were then coated with the saturant described in Example 1. Table II sets forth the composition of these samples as well as the strength properties and the resistance to wear of the coated webs as determined according to the procedure described in Example 1.

TABLE II

| Example | Fiber weight (g/m$^2$) | Total weight (g/m$^2$) | Final thickness (mm) | Tensile[1] (10$^2$ N/m) MD | Tensile[1] (10$^2$ N/m) XD | Pad life[2] (min) | Pad life[2] SD (min) |
|---|---|---|---|---|---|---|---|
| Control A | 465 | 1170 | 28 | 51 | 75 | 1.1 | 0.2 |
| 1 | 455 | 1110 | 37 | 37 | 44 | 6.8 | 4.8 |
| 2 | 405 | 1000 | 36 | 35 | 42 | 3.6 | 0.1 |
| 3 | 345 | 870 | 32 | 35 | 33 | 2.1 | 0.8 |
| 4 | 300 | 715 | 28 | 25 | 32 | 1.8 | 0.7 |
| 5 | 270 | 590 | 25 | 25 | 25 | 1.6 | 0.5 |
| 6 | 230 | 545 | 23 | 18 | 19 | 1.3 | 0.9 |

[1]MD means machine direction; XD means cross direction.
[2]SD means standard deviation.

The data in Table II show that buffing pads containing helically crimped fibers have longer pad life than do buffing pads containing only stuffer box crimped fibers, even when the pads containing helically crimped fibers had thicknesses and weights below that of the pads containing only stuffer box crimped fibers.

EXAMPLE 7

A nonwoven web was prepared by blending of 30% by weight 15 denier melt bondable fiber (as described in Example 1), 35% by weight 60 denier, helically crimped polyester staple fibers (as described in Example 1), and 35% by weight 140 denier helically crimped tensilized polyester staple fiber which had been cut to 75 to 100 mm in length. The 140 denier fiber had 1.6 crimps per 25 mm, had a tenacity of 3.4 g/denier, and had a crimp index of 52 before and after exposure to heat (5 minutes at 175° C.). The nonwoven web was heated for three minutes to activate the melt bondable fibers to produce a web having a weight of 500 g/m$^2$ and a thickness of 31 mm. After saturation with the saturant described in Example 1 and heat treatment to cure the binder, the total weight of the web was about 1180 g/m$^2$. Thickness of the dry saturated product was 30 mm. Average accelerated wear life was 4.5 minutes, with a standard deviation of 1.1 minutes.

COMPARATIVE EXAMPLE B

A nonwoven web was made by blending 30% by weight 15 denier staple binder fiber (as described in Example 1), 35% by weight 50 denier stuffer box crimped polyester staple fiber (as described in Comparative Example A), and 35% by weight 100 denier stuffer box crimped tensilized polyester staple fiber, which had been cut in 75 to 100 mm lengths. The nonwoven web was heated for 6 minutes at 125° C. to activate the melt bondable fibers. The nonwoven web initially weighed 490 g/m$^2$. After saturation with the saturant described in Example 1 and curing to dry the saturant, the dry product weighed about 1210 g/m$^2$ and was about 25 mm thick. Average accelerated wear life was 2.7 minutes, with a standard deviation of 0.4 minute.

EXAMPLES 8–11

Nonwoven abrasive products were made having various combinations of staple fibers, including conventional stuffer box crimped fibers, bicomponent melt bondable fibers, and helically crimped (edge crimped) fibers. Nonwoven webs were formed from the fiber compositions set forth in Table III by means of a Hergeth mechanical nonwoven forming machine.

TABLE III

| Example | Fiber description | Weight of nonwoven web (g/m$^2$) |
|---|---|---|
| 8 | 50% 50 denier melt bondable copolyester[1] | 124 |

TABLE III-continued

| Example | Fiber description | Weight of nonwoven web (g/m²) |
|---|---|---|
| | 50% 65 denier helically crimped nylon 66 | |
| 9 | 25% 50 denier melt bondable copolyester[1] | 131 |
| | 75% 65 denier helically crimped nylon 66 | 131 |
| 10 | 50% 50 denier stuffer box crimped nylon 66 | 135 |
| | 50% 65 denier helically crimped nylon 66 | |
| 11 | 100% 65 denier helically crimped nylon 66 | 135 |
| Comparative C | 100% 75 denier stuffer box crimped nylon 66 | 138 |
| Comparative D | 50% 75 denier stuffer box crimped nylon 66 | 130 |
| | 50% 50 denier melt bondable copolyester | |

[1]The fiber was of the core and sheath type, the core comprising polyethylene terephthalate, the sheath comprising a copolyester of ethylene terephthalate and isophthalate.

The following table sets forth the properties of the 50 denier melt bondable fibers, 65 denier helically crimped fibers, and 75 denier stuffer box crimped fibers.

TABLE IV

| Fiber | Tenacity (g/denier) | Crimps /25 mm | Crimp index (before heat exposure) | Crimp index (after heat exposure) | Length (mm) |
|---|---|---|---|---|---|
| 50 denier melt bondable | 2.1 | 6.5 | 20.8 | — | 70 |
| 65 denier helically crimped | 4.9 | 1.8 | 13.6 | 13.9 | 110 |
| 75 denier stuffer box crimped | 3.6 | 7.5 | 42.8 | — | 50 |

The nonwoven webs of Examples 8, 9, and Comparative Example D were passed at the rate of 6 meters per minute through a 4 meter long hot air oven at 170° C. to activate the melt bondable fibers. Bonded webs of Examples 8, 9, and Comparative Example D and unbonded webs of Examples 10, 11, and Comparative Example C were coated with the prebond resinous binder described in Table V below.

TABLE V

| Component | Amount (percent by weight) |
|---|---|
| Polymethylene polyphenyl polyisocyanate (Mondur MRS, commercially available from Mobay Co.) | 38.58 |
| Polypropylene glycol, PPG 425 | 12.86 |
| Xylol | 44.58 |
| Potassium lactate capsules (75% active as described in U.S. Patent No. 3,860,565) | 3.94 |
| Silicone Defoamer Y-30 (commercially available from Dow Corning Corp.) | 0.04 |

The coating was applied to the nonwoven web by means of a two-roll coater and then cured by passing the coated web through a hot air oven 18 meters long at a temperature of 150? C. and at a speed of 6 meters per minute.

The slurry coating set forth in Table VI below was then applied by means of roll coating to each of the prebonded nonwoven webs of Examples 8, 9, 10, and 11 and Comparative Examples C and D.

TABLE VI

| Component | Amount (percent by weight) |
|---|---|
| Propylene glycol monomethyl ether | 23.02 |
| Lithium stearate | 1.86 |
| Phenol formaldehyde thermosetting resin, 70% | 22.22 |
| Aluminum oxide abrasive, grade 100–150 | 51.90 |
| Colloidal silica (Cabosil M5) | 1.00 |

After being coated, the nonwoven webs were passed through a 4 meter long hot air oven at 165° C. at 1.5 meter per minute to cure the resinous binder. Web weights, coating weight, web thicknesses, and tensile are set forth in Table VII.

TABLE VII

| Example | Fiber weight (g/m²) | Prebond added (g/m²) | Total dry weight (g/m²) | Finished web thickness[1] (mm) | Tensile (N × 10²/m) MD | Tensile (N × 10²/m) CD |
|---|---|---|---|---|---|---|
| 8 | 124 | 105 | 1020 | 11 | 21 | 8 |
| 9 | 131 | 97 | 1045 | 12 | 24 | 9 |
| 10 | 135 | 67 | 1045 | 10 | 26 | 9 |
| 11 | 135 | 90 | 1065 | 14 | 30 | 11 |
| Comparative C | 138 | 85 | 1090 | 7 | 24 | 10 |
| Comparative D | 130 | 85 | 1030 | 4 | 15 | 6 |

[1]average of nine web thickness measured under a pressure of 115 Pa

Discs were cut from each of the webs of Examples 8, 9, 10, and 11 and Comparative Examples C and D. These discs were 150 mm in diameter and had 32 mm center holes. The six discs were mounted on an arbor and compressed to 25 mm thickness by flanges 125 mm in diameter having a 32 mm center hole. The compressed and restrained discs were then rotated at 2000 rpm. A workpiece of type 6061 perforated aluminum sheet, 50 mm by 280 mm, was urged for three minutes against the rotating abrasive disc with a 22 N force and moved back and forth 150 mm against the rotating discs. The workpiece had 6.4 mm staggered pattern, had 6.4 mm diameter perforations, had holes spaced 8.7 mm on center, was 48% open, and was 1.63 mm thick. Weight loss of the six discs and weight loss (cut) of the perforated aluminum sheet were recorded in Table VIII.

TABLE VIII

| Example | Cut (g) | Wear (percent) | Efficiency (cut/% wear) |
|---|---|---|---|
| 8 | 0.64 | 21.2 | 0.041 |
| 9 | 0.53 | 13.2 | 0.049 |
| 10 | 0.36 | 7.9 | 0.062 |
| 11 | 0.47 | 6.4 | 0.094 |
| Comparative C | 0.30 | 8.1 | 0.045 |
| Comparative D | 0.61 | 21.9 | 0.039 |

The pads of Examples 10 and 11, which contained 50% or more helically crimped fibers, showed equal or better cut and much greater efficiency than the pad of Comparative Example C. The pads of Examples 8 and 9 showed enhanced cut or efficiency when compared with the pad of Comparative Example D.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An article suitable for buffing floors consisting of an open, lofty nonwoven web comprising at least 30% by weight of helically crimped, synthetic, organic, staple fibers, said web containing a binder and abrasive particles ranging in grade from about 36 to about 1000.

2. The article of claim 1 wherein the web comprises at least 50% by weight of helically crimped fibers.

3. The article of claim 1 wherein the web comprises at least 70% by weight of helically crimped fibers.

4. The article of claim 1 wherein said web further comprises melt bondable fibers.

5. The article of claim 1 wherein said web further comprises stuffer box crimped fibers.

6. The article of claim 1 wherein said helically crimped fibers are stabilized.

7. The article of claim 1 wherein said helically crimped fibers have from about 1 to about 15 crimps per 25 mm.

8. The article of claim 1 wherein said helically crimped fibers have a crimp index from about 35% to about 70%.

9. The article of claim 1 wherein said helically crimped fibers comprise polyethylene terephthalate.

10. The article of claim 1 wherein said helically crimped fibers comprise nylon.

11. The article of claim 1 wherein said helically crimped fibers comprise polyester.

12. The article of claim 1 wherein said fibers range from about 60 mm to about 150 mm in length.

13. An article suitable for buffing floors consisting of an open, lofty nonwoven web comprising at least 30% by weight of helically crimped, synthetic, organic, staple fibers, said web containing a binder and abrasive particles ranging in grade from about 36 to about 1000, wherein said helically crimped fibers are stabilized, have from about 1 to about 15 crimps per 25 mm, have a crimp index from about 35% to about 70%, and range from about 60 mm to about 150 mm in length.

* * * * *

UNITED STATES PATENT AND TRADEMARK OFFICE

CERTIFICATE OF CORRECTION

PATENT NO. : 4,893,439

DATED : January 16, 1990

INVENTOR(S) : McAvoy et al.

It is certified that error appears in the above-identified patent and that said Letters Patent is hereby corrected as shown below:

Col. 5, line 11, "denie" should read --denier--.

Col. 6, lines 58, 59, "saturation" should read --saturant into--.

Col. 9, line 65, "?" should read --$^{0}$--.

Signed and Sealed this

Seventeenth Day of November, 1992

*Attest:*

DOUGLAS B. COMER

*Attesting Officer*

*Acting Commissioner of Patents and Trademarks*